US012460859B2

(12) United States Patent
You et al.

(10) Patent No.: US 12,460,859 B2
(45) Date of Patent: Nov. 4, 2025

(54) REFRIGERATOR

(71) Applicant: SAMSUNG ELECTRONICS CO., LTD., Suwon-si (KR)

(72) Inventors: Youngmin You, Suwon-si (KR); Jinyoung Song, Suwon-si (KR); Ilsung Bae, Suwon-si (KR); Byungkwan Yang, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 59 days.

(21) Appl. No.: 18/515,910

(22) Filed: Nov. 21, 2023

(65) Prior Publication Data

US 2024/0085098 A1 Mar. 14, 2024

Related U.S. Application Data

(63) Continuation of application No. PCT/KR2022/011437, filed on Aug. 3, 2022.

(30) Foreign Application Priority Data

Aug. 26, 2021 (KR) ..... 10-2021-0113520

(51) Int. Cl.
*F25D 27/00* (2006.01)
*F25D 17/06* (2006.01)

(52) U.S. Cl.
CPC ..... *F25D 27/00* (2013.01); *F25D 17/062* (2013.01); *F25D 2317/0665* (2013.01); *F25D 2327/00* (2013.01)

(58) Field of Classification Search
CPC ..... F25D 27/00; F25D 17/062; F25D 2317/0665; F25D 2327/00
(Continued)

(56) References Cited

U.S. PATENT DOCUMENTS 7,670,018 B2 3/2010 Kim et al.
8,459,818 B2 * 6/2013 Becke ..... F25D 27/00 362/92
(Continued)

FOREIGN PATENT DOCUMENTS

JP 2001349666 A 12/2001
JP 2005257209 A 9/2005
(Continued)

OTHER PUBLICATIONS

International Search Report and Written Opinion for International Application No. PCT/KR2022/011437; International Filing Date Aug. 3, 2022; Date of Mailing Nov. 22, 2022; 41 Pages.

*Primary Examiner* — Elmito Breval
*Assistant Examiner* — Hana S Featherly
(74) *Attorney, Agent, or Firm* — CANTOR COLBURN LLP

(57) ABSTRACT

A refrigerator includes an outer case forming the exterior of a main body, an inner case disposed inside the outer case to form a storage compartment, an upper duct including an upper outlet to discharge cold air downward toward the storage compartment, and disposed in the inner case to form an upper flow path to supply cold air to the upper outlet, a rear duct including a rear flow path configured to guide the cold air to the upper flow path, and a rear outlet configured to discharge cold air from the rear flow path into the storage compartment, a light emitting diode (LED) module coupled to the upper duct to emit light toward the storage compartment and including a plurality of LEDs, and a reflective cover disposed on a rear side of the storage compartment to be coupled to the rear duct and reflecting light from the LED module.

20 Claims, 14 Drawing Sheets

(58) Field of Classification Search
USPC ..... 362/92
See application file for complete search history.

(56) References Cited

U.S. PATENT DOCUMENTS

| | | | | |
|---|---|---|---|---|
| 9,671,149 | B2 | 6/2017 | Kim et al. | |
| 9,879,900 | B1 * | 1/2018 | Ammerman | F25D 23/04 |
| 10,724,790 | B2 | 7/2020 | Seo | |
| 10,830,531 | B2 | 11/2020 | Seo et al. | |
| 11,454,388 | B2 | 9/2022 | Kim et al. | |

FOREIGN PATENT DOCUMENTS

| | | | |
|---|---|---|---|
| JP | 2013174382 | A | 9/2013 |
| KR | 200125937 | Y1 | 11/1998 |
| KR | 20060023268 | A | 3/2006 |
| KR | 100798944 | B1 | 1/2008 |
| KR | 20090111376 | A | 10/2009 |
| KR | 20090132400 | A | 12/2009 |
| KR | 101104177 | B1 | 1/2012 |
| KR | 101110507 | B1 | 1/2012 |
| KR | 20120082992 | A | 7/2012 |
| KR | 101286902 | B1 | 7/2013 |
| KR | 20140124659 | A | 10/2014 |
| KR | 101728196 | B1 | 4/2017 |
| KR | 20200071247 | A | 6/2020 |
| WO | 2019163126 | A1 | 8/2019 |

* cited by examiner

REFRIGERATOR

CROSS-REFERENCE TO RELATED APPLICATIONS

This application is a continuation application, claiming priority under § 365(c), of International Application No. PCT/KR2022/011437, filed on Aug. 3, 2022, which is based on and claims the benefit of Korean Patent Application Number 10-2021-0113520, filed on Aug. 26, 2021, in the Korean Intellectual Property Office, the contents of which are incorporated by reference herein in their entireties.

BACKGROUND

(1) Field

The invention relates to a refrigerator having a lighting device, and more particularly to a refrigerator having a light that emits light toward a storage compartment.

(2) Description of the Related Art

In general, refrigerators are appliances that keep food fresh with a storage compartment for storing the food and a cold air supply device that supplies cold air to the storage compartment. The storage compartment includes a refrigerating compartment in which the food is kept refrigerated at a temperature of approximately 0° C. to 5° C., and a freezing compartment in which the food is kept frozen at a temperature of approximately 0° C. to −30° C.

Inner cases of the freezing and refrigerating compartments of such a refrigerator are provided with a lighting device that emits light therein so that items stored in the freezing and refrigerating compartments can be easily identified.

SUMMARY

In an embodiment, the invention is directed to providing a refrigerator including a light emitting diode (LED) module that emits light towards a storage compartment.

Further, in an embodiment, the invention is directed to providing a refrigerator having an LED module and a reflective member that enables a storage compartment to appear deeper and wider.

Further, in an embodiment, the invention is directed to providing a refrigerator in which fogging of a reflective member disposed at a rear side of a storage compartment is prevented.

According to an embodiment, a refrigerator includes an outer case, an inner case disposed inside the outer case to form a storage compartment, an upper duct including an upper outlet disposed on an upper portion of the storage compartment to discharge cold air downward toward the storage compartment, and disposed in the inner case to form an upper flow path to supply the cold air to the upper outlet, a rear duct including a rear flow path configured to guide the cold air to the upper flow path, and a rear outlet configured to discharge cold air from the rear flow path into the storage compartment to cool the storage compartment, a light emitting diode (LED) module coupled to the upper duct to emit light toward the storage compartment and including a plurality of LEDs arranged in a lateral direction, and a reflective cover disposed on a rear side of the storage compartment so as to be coupled to the rear duct and configured to reflect light from the LED module.

In an embodiment, the LED module may be installed in the upper duct at an angle to allow the plurality of LEDs to emit light in a downwardly inclined direction toward the reflective cover.

In an embodiment, the LED module may include a base extending in the lateral direction to allow the plurality of LEDs to be arranged in the lateral direction, wherein the base may be installed in the upper duct at an angle to allow the plurality of LEDs to emit light in a downwardly inclined direction toward the reflective cover.

In an embodiment, the upper duct may include a module coupling portion disposed on a rear side of the upper outlet, the module coupling portion including a recess which is recessed in an upwardly direction in the storage compartment, and an upper end of the base which may be inserted into the recess.

In an embodiment, the module coupling portion may further include a module support portion located adjacent to the recess and extending downward, wherein the module support portion may support a lower end of the base.

In an embodiment, the refrigerator may further include a lower cover configured to cover a lower side of the module coupling portion, wherein the lower cover may include a guide wall arranged to guide cold air discharged from the upper outlet, and a partition wall spaced apart from the guide wall to form a receiving groove in which a lower end of the base is received.

In an embodiment, the upper duct may include an inclined surface inclined in a downwardly direction toward a rear side to reflect light from the plurality of LEDs toward the storage compartment.

In an embodiment the refrigerator may further include a lower cover coupled to a lower side of the upper duct such that the LED module is disposed between the upper duct and the lower cover, and a light guide panel coupled to the lower cover to diffuse light emitted from the plurality of LEDs and reflected from the inclined surface.

In an embodiment, the light guide panel may be inclined upwardly toward a rear side thereof.

In an embodiment, the LED module may be a first LED module, and the refrigerator may further include a second LED module coupled to the upper duct to be spaced apart from the first LED module in a lateral direction, the second LED module including a plurality of LEDs arranged in the lateral direction.

In an embodiment, the reflective cover may include a glass material.

In an embodiment, the refrigerator may further include a plurality of third LED modules provided on both sides of the storage compartment to emit light toward the storage compartment and including a plurality of LEDs arranged in a horizontal direction.

In an embodiment, the rear duct may include a front cover provided on a rear side of the reflective cover and including a cold air supply port configured to supply cold air to the upper duct, a middle cover provided on a rear side of the front cover and guiding cold air to the upper duct and the cold air supply port, a rear cover coupled to a rear side of the middle cover to form the rear flow path, wherein the rear flow path is configured to guide cold air to the upper duct and the cold air supply port, and a blower fan disposed on the middle cover and configured to blow cold air into the rear flow path.

According to another embodiment, a refrigerator includes a main body, a storage compartment formed in the main body and having a front opening, a door configured to open and close the front opening, an evaporator configured to generate cold air, a rear duct including a rear flow path configured to guide cold air generated by the evaporator, and a rear outlet configured to discharge the cold air from the rear flow path into the storage compartment to cool the storage compartment, an upper duct provided in the storage compartment, and including an upper flow path connected to the rear flow path and an upper outlet configured to discharge the cold air from the rear flow path in a direction downward toward the storage compartment, a first light emitting diode (LED) module coupled to the upper duct to emit light in a direction toward the storage compartment and including a plurality of first LEDs arranged in a lateral direction, a second LED module coupled to the upper duct to be spaced apart from the first LED module in the lateral direction and including a plurality of second LEDs arranged in the lateral direction, a plurality of third LED modules arranged on both sides of the storage compartment and including a plurality of third LEDs arranged in a horizontal direction to emit light in a direction toward the storage compartment, and a reflective cover disposed on a rear side of the storage compartment, wherein the reflective cover is coupled to the rear duct and configured to reflect light from the first LED module, the second LED module, and the plurality of third LED modules.

In an embodiment, the first LED module and the second LED module may be installed in the upper duct at an angle to allow the plurality of first LEDs and the plurality of second LEDs to emit light in a downwardly inclined direction toward the reflective cover.

In an embodiment, the refrigerator may further include module covers provided on each of a left wall and a right wall of the storage compartment, wherein each of the plurality of third LED modules may be installed at an angle on the corresponding module cover so as to emit light in a direction inclined toward the reflective cover.

In an embodiment, the upper duct may include an inclined surface to reflect the light from the plurality of first LEDs of the first LED module toward the storage compartment, and wherein the module cover may include an inclined surface to reflect the light from the plurality of third LEDs of the third LED module toward the storage compartment.

In an embodiment, the refrigerator may further include a lower cover coupled to a lower side of the upper duct such that the LED module is disposed between the upper duct and the lower cover, and a light guide panel coupled to the lower cover to diffuse light from the plurality of LEDs and the inclined surface.

According to another embodiment, a refrigerator includes an outer case, an inner case disposed in the outer case to form a storage compartment, an evaporator configured to generate cold air, a rear duct including a rear flow path configured to guide cold air generated from the evaporator, and a rear outlet configured to discharge cold air from the rear flow path into the storage compartment to cool the storage compartment, an upper duct provided in the storage compartment, and including an upper flow path connected to the rear flow path and an upper outlet configured to discharge cold air downward toward the storage compartment, a first LED module coupled to the upper duct to emit light toward the storage compartment and including a plurality of first LEDs arranged in a lateral direction, a second LED module coupled to the upper duct to be spaced apart from the first LED module in the lateral direction and including a plurality of second LEDs arranged in the lateral direction, a pair of third LED modules arranged on both sides of the storage compartment and including a plurality of third LEDs arranged in a horizontal direction to emit light toward the storage compartment, and a reflective cover disposed on a rear side of the storage compartment so as to be coupled to the rear duct and reflecting light from the first LED module, the second LED module, and the pair of third LED modules, and wherein the upper outlet may be disposed on a front side of the storage compartment.

In an embodiment, the LED module may include a base extending in a lateral direction to allow the plurality of LEDs to be arranged, wherein the base may be installed at an angle in the upper duct to allow the plurality of LEDs to emit light in a direction downwardly inclined toward the reflective cover.

According to various embodiments, the refrigerator may appear to be deeper and wider at a lower cost, thereby increasing consumer satisfaction.

Further, according to various embodiments, the refrigerator may have a structure to prevent loss of light emitted towards the storage compartment using a smaller number of LEDs, thereby saving a cost of manufacture.

Further, according to various embodiments, the refrigerator may prevent external high temperature and high humidity air from entering the storage compartment while the door is being opened and closed, thereby blocking fogging of the reflective member.

DETAILED DESCRIPTION

Figure 1:
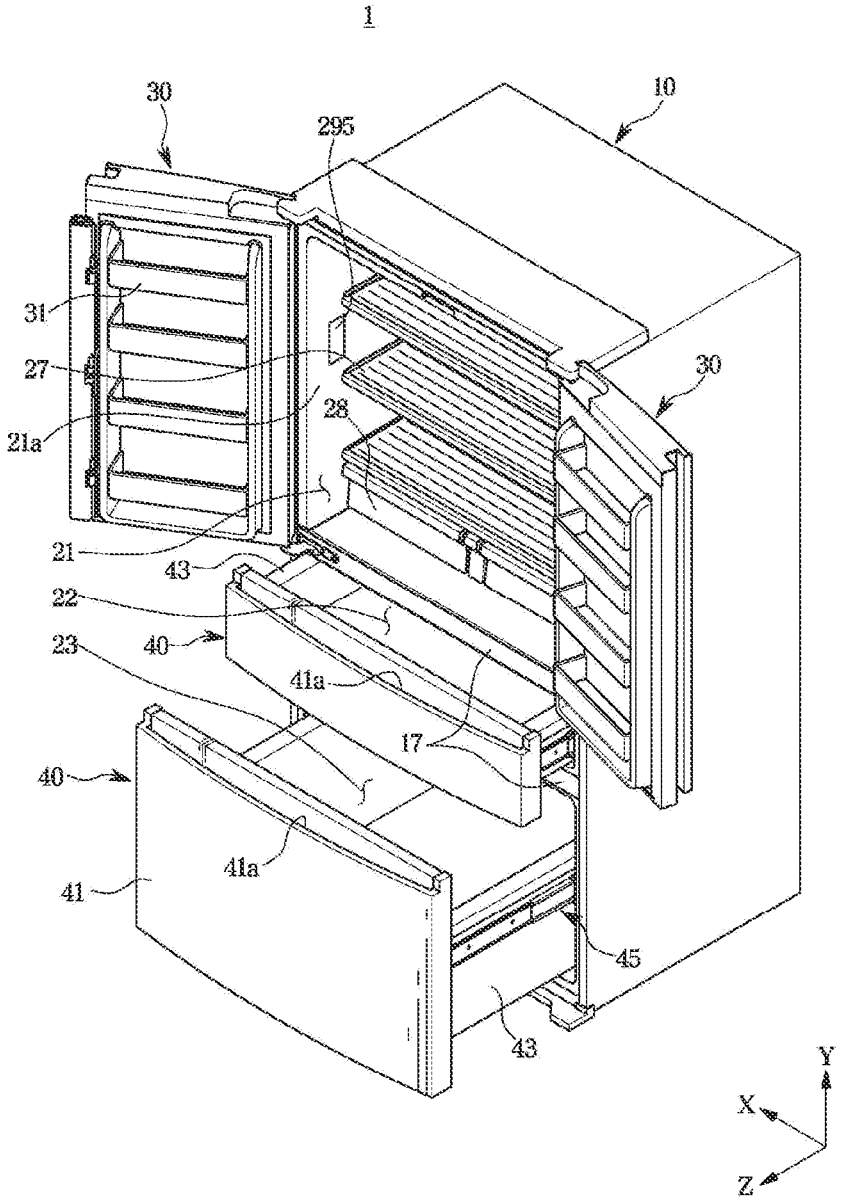
FIG. 1 is a perspective view illustrating a refrigerator according to an embodiment.

Embodiments described in the disclosure and configurations shown in the drawings are merely examples of embodiments of the invention and may be modified in various different ways at the time of filing of the present application.

In addition, the same reference numerals or symbols shown in the drawings indicate elements and/or components performing substantially the same function. Moreover, within the Figures and the text of the disclosure, a reference number indicating a singular form of an element may also be used to reference a plurality of the singular element.

Also, the terms used herein are used to describe the embodiments and are not intended to limit and/or restrict the invention. The singular forms "a," "an" and "the" are intended to include the plural forms as well, unless the context clearly indicates otherwise. In this disclosure, the terms "including". "having", and the like are used to specify features, figures, steps, operations, elements, components, or combinations thereof, but do not preclude the presence or addition of one or more of the features, figures, steps, operations, elements, components, or combinations thereof.

It will be understood that the terms first, second, primary, secondary, etc., may be used herein to describe various elements, but elements are not limited by these terms. These terms are only used to distinguish one element from another element. For example, without departing from the scope of the invention, a first element may be termed as a second element, and a second element may be termed as a first element.

The terms "front", "rear", "upper", "lower", "top", and "bottom" as herein used are defined with respect to the drawings, but the terms may not restrict the shape and position of the respective components.

In this specification, the terms "comprises," "includes" and the like are intended to designate the presence of the features, numbers, steps, actions, components, parts, or combinations thereof described, and do not preclude the possibility of the presence or addition of one or more other features, numbers, steps, actions, components, parts, or combinations thereof.

Further, as used herein, ordinary terms such as "first," "second" and the like may be used to describe various components, but the components are not limited by such terms, and such terms are used only to distinguish one component from another. For example, without departing from the scope of the present invention, a first component may be named a second component, and similarly, a second component may be named a first component.

The terminology used herein is for the purpose of describing particular embodiments only and is not intended to be limiting. As used herein "a," "n," "t," "e" and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." The term "and/or" includes any combination of a plurality of related recited items or any one of a plurality of related recited items.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments will be described in detail with reference to the accompanying drawings.

Figure 2:
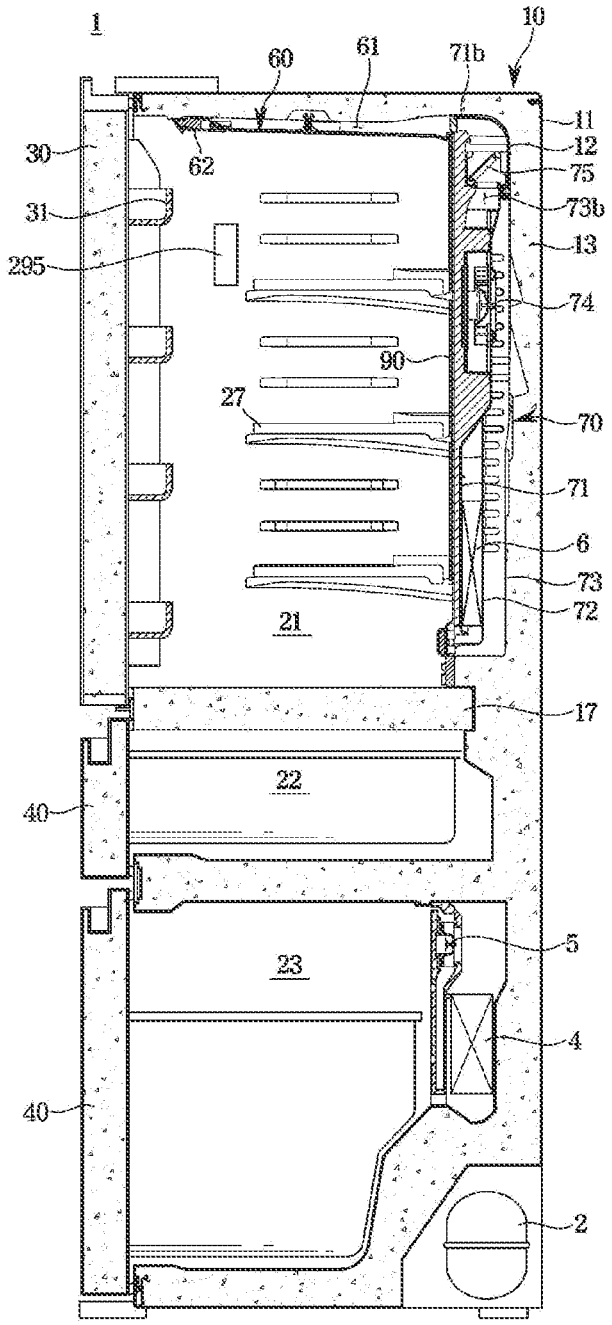
FIG. 2 is a side cross-sectional view illustrating a storage compartment and a duct of the refrigerator shown in FIG. 1, according to an embodiment.

In an embodiment and referring to FIGS. 1 and 2, a refrigerator 1 may include a main body 10 having storage compartments 21, 22, and 23, doors 30 and 40 provided to open and close the storage compartments 21, 22, and 23, and a cold air supply device provided to supply cold air to the storage compartments 21, 22, and 23.

In an embodiment, the main body 10 may include an outer case 11 and an inner case 12 provided within the outer case 11 to form the storage compartments 21, 22, and 23. The main body 10 may include an insulator 13 arranged between the outer case 11 and the inner case 12. The insulator 13 may include urethane foam insulation, and if necessary, may include a vacuum insulation panel. The main body 10 may include an intermediate wall 17 for partitioning the storage compartments 21, 22, and 23 in a vertical direction.

In an embodiment, the storage compartments 21, 22, and 23 may be used as a refrigerating compartment for keeping food refrigerated at approximately 0° C. to approximately 5° C., and as a freezing compartment for storing food frozen at approximately −30° C. to approximately 0° C.

In an embodiment, the storage compartments 21, 22, and 23 may have an open front to allow food to be placed inside of storage compartments 21, 22, and 23 and removed out of the storage compartments 21, 22, and 23, and the open front of the storage compartments 21, 22, and 23 may be opened and closed by the doors 30 and 40. The storage compartments 21, 22, and 23 may be provided with a shelf 27 on which food may be placed thereon. A left wall 21*a* may be provided on a left side of the storage compartment 21. A right wall 21*b* (see FIG. 10) may be provided on a right side of the storage compartment.

In an embodiment, the door 30 may be coupled to the main body 10 so as to be rotatable in a left and/or right direction. A door guard 31 for storing food may be provided on a rear side of the door 30.

In an embodiment, the door 40 may be slidably provided so as to be inserted into or removed from the storage compartments 22 and 23, and may include a door portion 41 for covering the open front of the storage compartments 22 and 23, and a basket 43 coupled to the rear side of the door portion 41. The basket 43 may be slidably supported by rails 45. The door portion 41 may be provided with a handle 41*a*.

In an embodiment, the cold air supply device may generate cold air using the latent heat of evaporation of the refrigerant through a cooling cycle. The cold air supply device may include a compressor 2, a condenser, an expansion device, evaporators 4 and 6, and blower fans 5 and 74.

In an embodiment, the evaporators 4 and 6 may be disposed behind the storage compartments 21 and 23 to generate cold air. The blower fans 5 and 74 may be provided at a rear side of storage compartments 21 and 23. The cold air generated in the evaporator 4 may flow into the storage compartment 23 through the blower fan 5. The cold air generated in the evaporator 6 may flow into a rear flow path 73*b* through the storage compartment 21 and/or the blower fan 74.

In an embodiment, the refrigerator 1 may include a duct 50 (see FIG. 3) provided inside the inner case 12. The duct 50 (see FIG. 3) may include an upper duct 60 provided on an upper portion of the storage compartment 21 and a rear duct 70 disposed at the rear side of the storage compartment 21.

In an embodiment, the upper duct 60 may include an outlet 62 disposed on the upper portion of the storage compartment 21 to discharge cold air downward toward the storage compartment 21. The upper duct 60 may be provided to form a flow path 61 that supplies cold air to the outlet 62. The flow path 61 may be an upper flow path 61. The outlet 62 may be an upper outlet 62.

In an embodiment, the rear duct 70 may include the rear flow path 73*b* that guides cold air to supply the cold air toward the upper flow path 61. The cold air generated in the evaporator 6 may be drawn into the rear flow path 73*b* through the blower fan 74. The cold air in the rear flow path 73*b* may be guided to the upper outlet 62 through the upper flow path 61.

Figure 3:
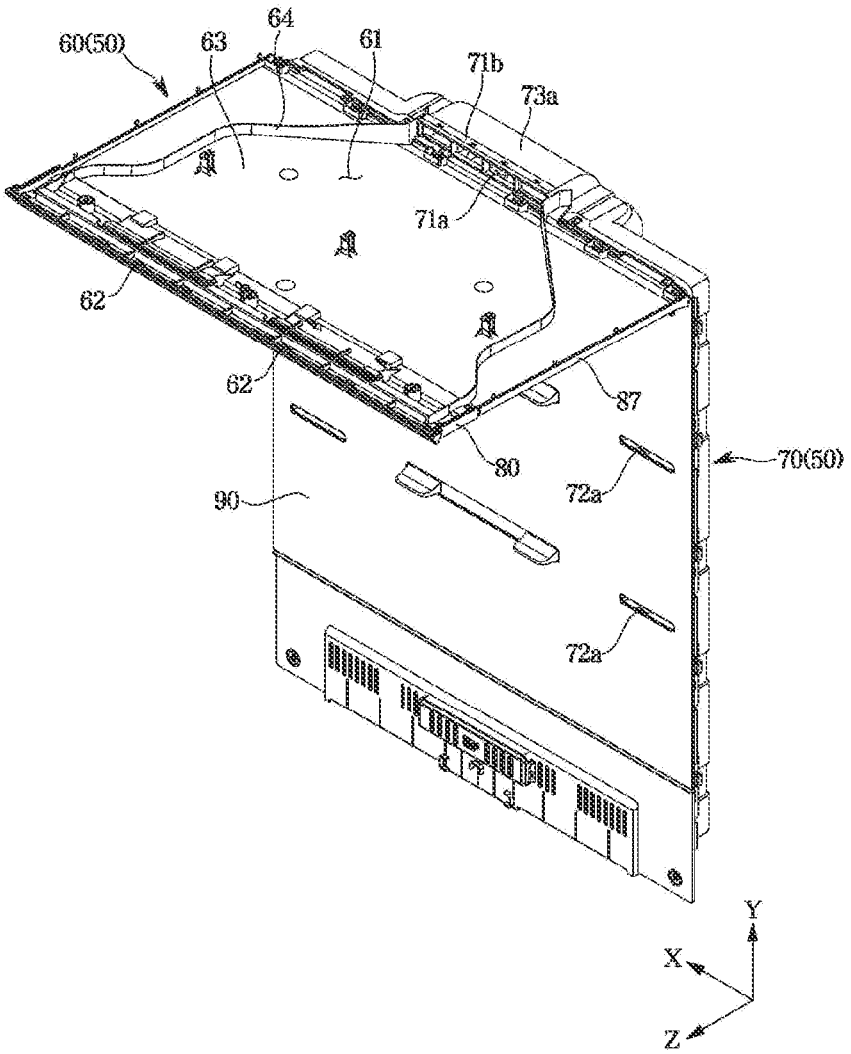
FIG. 3 is a perspective view illustrating the duct and a reflective cover of the refrigerator shown in FIG. 1, according to an embodiment.
Figure 4:
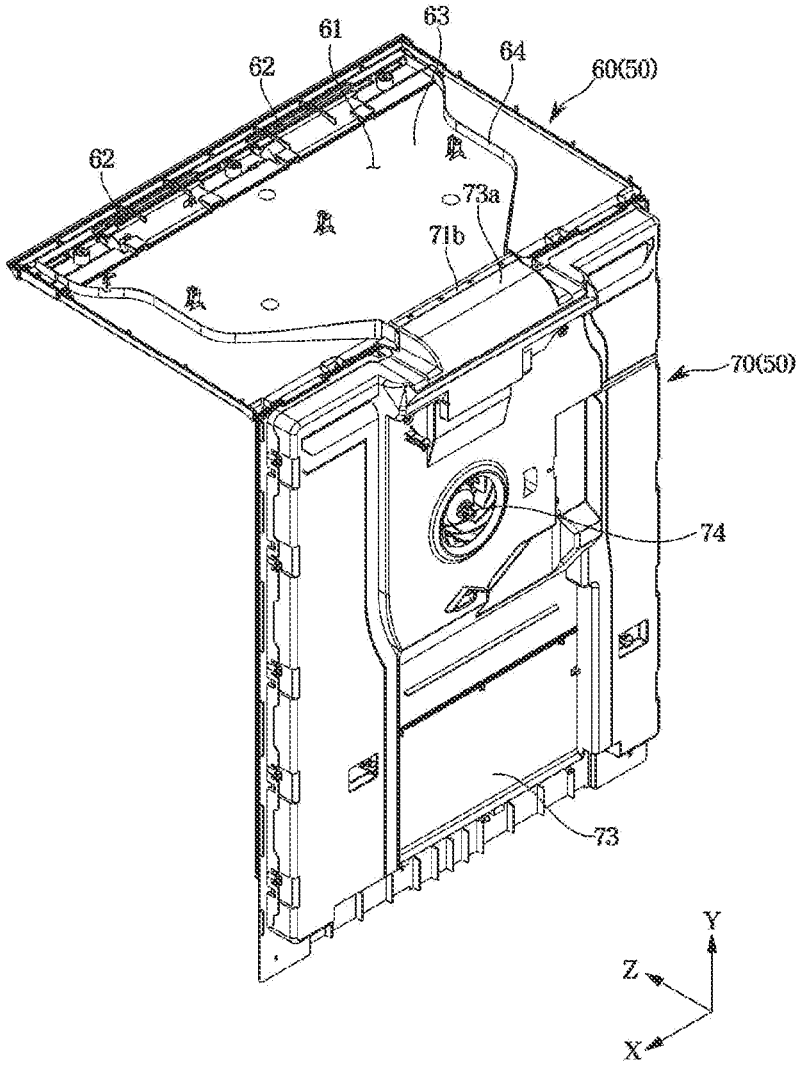
FIG. 4 is a perspective view illustrating the duct of the refrigerator shown in FIG. 1 from another angle, according to an embodiment.
Figure 5:
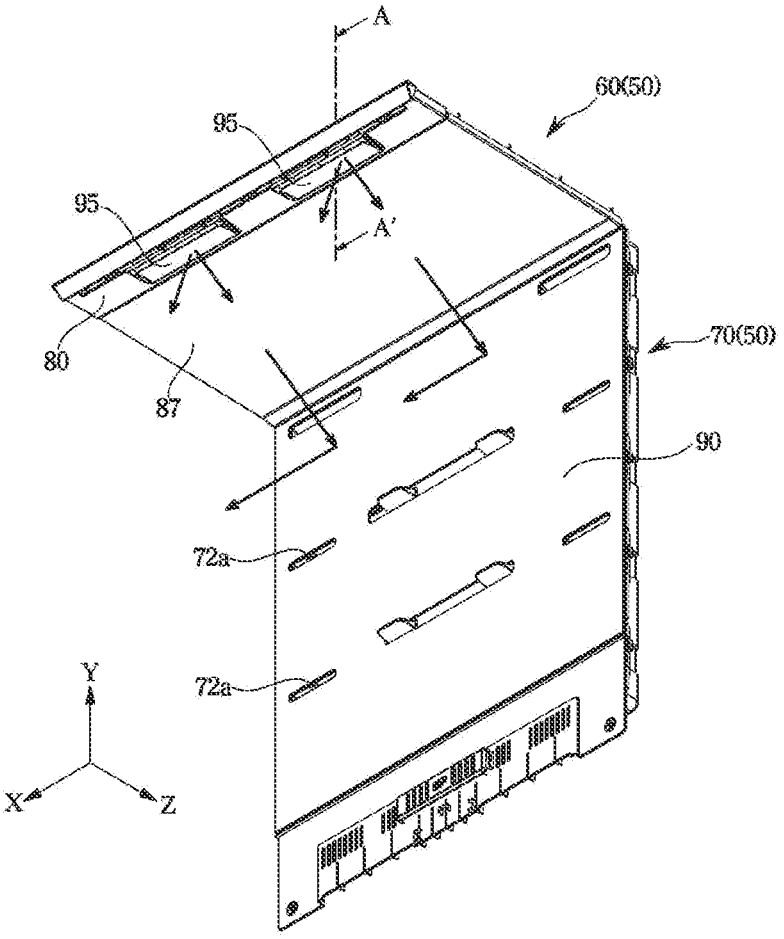
FIG. 5 is a perspective view illustrating the duct and the reflective cover of the refrigerator shown in FIG. 1 from the bottom, according to an embodiment.
Figure 6:
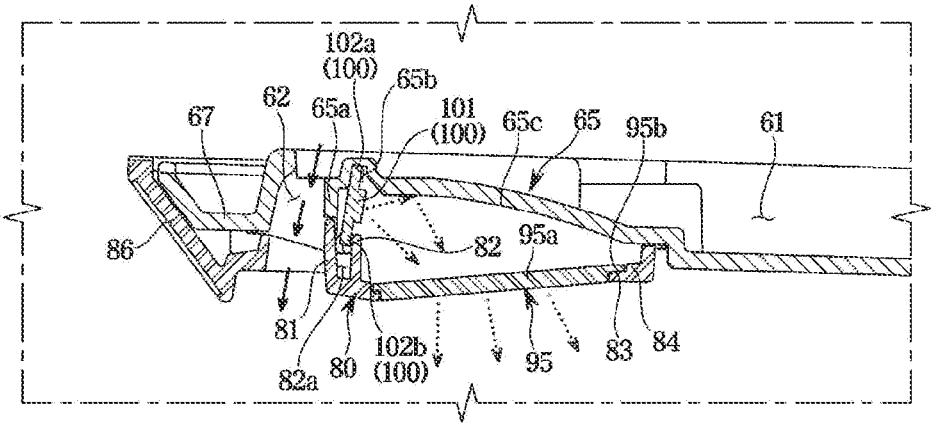
FIG. 6 is a side cross-sectional view of the duct of the refrigerator shown in FIG. 1 taken along line A-A' of FIG. 5, according to an embodiment.
Figure 7:
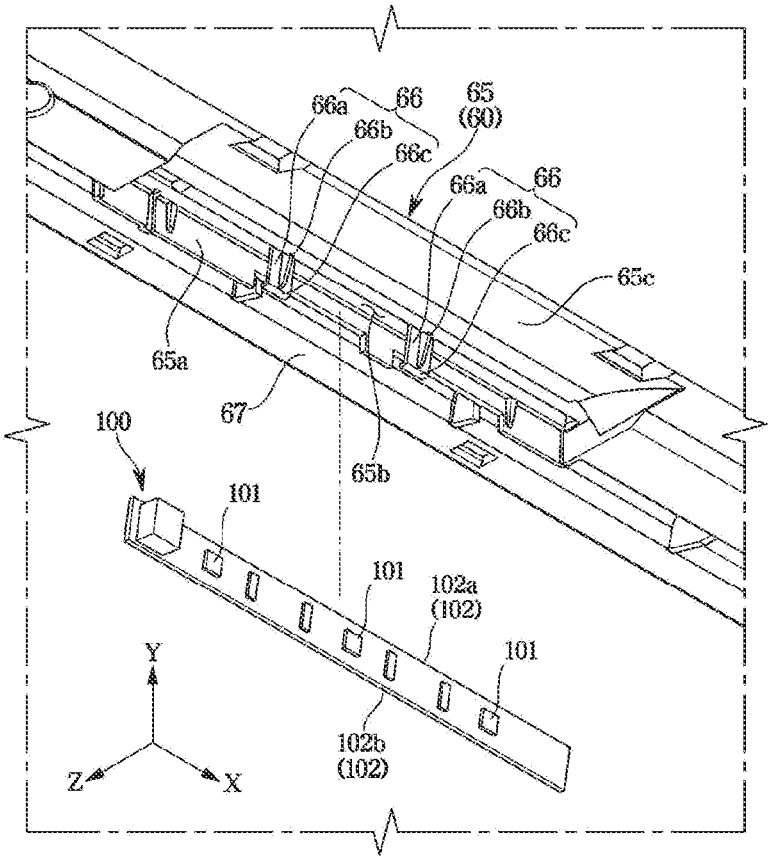
FIG. 7 is a perspective view illustrating an upper duct of the refrigerator shown in FIG. 1 and an LED module being coupled therewith, according to an embodiment.

In an embodiment and referring to FIGS. 2 to 4, the duct 50 may include the upper duct 60 and the rear duct 70. The upper duct 60 and the rear duct 70 may be formed as one piece, but according to an embodiment, the upper duct 60 and the rear duct 70 may be provided separately and be assembled together to form the duct 50.

In an embodiment, the upper duct 60 may include an upper cover 63 that partitions the storage compartment 21 and the upper flow path 61, and a pair of guide walls 64 that protrude from the upper cover 63 and face each other to form the upper flow path 61.

In an embodiment, the upper duct 60 may be coupled to an upper surface of the storage compartment 21, and the upper flow path 61 may be surrounded by the upper cover 63, the pair of guide walls 64, and the inner case 12. However, in an embodiment, a separate member (not shown) may be provided between the upper duct 60 and the inner case 12, so that the upper flow path 61 may be surrounded by the upper cover 63, the pair of guide walls 64, and the separate member.

In an embodiment, the upper flow path 61 may guide the cold air supplied from a cold air supply port 71*a* to the upper outlet 62. The upper outlet 62 may be provided in a plurality, and the cold air discharged through the upper outlet 62 may be discharged downward toward the storage compartment 21.

In an embodiment, the rear duct 70 may include the rear flow path 73*b* that guides the cold air generated from the evaporator 6, and a rear outlet 72*a* that discharges the cold air from the rear flow path 73*b* into the inside of the storage chamber 21 so as to cool the storage chamber 21.

In an embodiment, the rear duct 70 may include the cold air supply port 71*a*, a cold air supply frame 71*b*, and a cold air supply cover 73*a*. The cold air in the rear flow path 73*b* may be guided to the cold air supply port 71*a* by the cold air supply cover 73*a*. The rear flow path 73*b* may communicate with the upper flow path 61 through the cold air supply port 71*a*.

In an embodiment, the cold air generated in the evaporator 6 may flow into the rear flow path 73*b* through the blower fan 74. The cold air flowing through the rear flow path 73*b* may flow toward an upper side of the upper duct 60 through the cold air supply port 71*a*.

In an embodiment and referring to FIGS. 5 to 8, the refrigerator 1 may include a light emitting diode (LED) module 100 coupled to the upper duct 60 to emit light toward the storage compartment 21. The LED module 100 may include a plurality of LEDs 101 arranged in a lateral direction (X direction).

In an embodiment, the respective LED module 100 may include a plurality of LEDs 101 and a base 102. The plurality of LEDs 101 may be one or more. The base 102 may include a circuit board. Each of the plurality of LEDs 101 may be coupled to the base 102 and disposed along the lateral direction (X direction) and spaced apart from each other. In an embodiment, the plurality of LEDs 101 is shown as three, but the number thereof is not limited thereto.

In an embodiment, the refrigerator 1 may include a reflective cover 90 disposed at the rear side of the storage compartment 21 and reflecting light emitted from the LED module 100.

In an embodiment, the refrigerator 1 may include the upper outlet 62 disposed on a front side of the storage compartment 21 to discharge the cold air in the upper flow path 61 toward the storage compartment 21. The LED module 100 may be located adjacent to a rear side of the upper outlet 62. This structure may allow the LED module 100 to be coupled to the upper duct 60 for placement in the front side of the storage compartment 21. In addition, although the door 30 is opened, the reflective cover 90 may be prevented from fogging up by the cold air being discharged from the upper outlet 62. More particularly, when high-temperature and high-humidity outside air enters the storage compartment 21 due to the opening of the door 30, the cold air discharged from the upper outlet 62 may prevent the reflective cover 90 from fogging up.

In an embodiment, the LED module 100 may be arranged such that the plurality of LEDs 101 emits light in a direction downwardly inclined towards the reflective cover 90. In other words, the LED module 100 may be installed at an angle in the upper duct 60.

More specifically, in an embodiment, the LED module 100 may include the base 102 extending in the lateral direction (X direction) to allow the plurality of LEDs 101 to be arranged in the lateral direction, and the base 102 may be installed to be inclined in the upper duct 60.

In an embodiment, such a configuration may allow the light emitted from the plurality of LEDs 101 to be directed towards the reflective cover 90, and thus more light may be directed towards the reflective cover 90 than in a noninclined LED module 100. The LED module 100 installed at an angle may allow more light to be reflected by the reflective cover 90. More light is reflected by the reflective cover 90, allowing a user to feel that the storage compartment 21 appears wider and deeper than its actual size, creating an aesthetic effect by feeling the luxurious interior space 21.

In an embodiment, the upper duct 60 may include a module coupling portion 65 disposed on the rear side of the upper outlet 62. The module coupling portion 65 may include a discharge wall 65*a*, a recess 65*b*, and an inclined surface 65*c*. The discharge wall 65*a* may form the upper outlet 62. The recess 65*b* which is recessed toward an upper side of the storage compartment 21 may be formed on a rear side of the discharge wall 65*a*. The inclined surface 65*c* which is inclined downwardly may be formed on a rear side of the recess 65*b*. The inclined surface 65*c* may be a curved surface. The inclined surface 65*c* may be provided to correspond to a first LED module 100.

In an embodiment, the LED module 100 may be obliquely inserted into the recess 65*b*. In particular, an upper end 102*a* of the base of the LED module 100 may be obliquely inserted into the recess 65*b*. A front surface of the recess 65*b* may be inclined forwardly and directed downwardly. Such a structure may allow the upper end 102*a* of the base to be inserted into the recess 65*b* responding to an inclination of the front surface of the recess 65*b*, thereby stably maintaining the LED module 100 in the inclined state. Due to the structure being configured to maintain a stable inclination, light from the plurality of LEDs 101 may reach the reflective cover 90 and be reflected toward the storage compartment 21. Accordingly, the user may perceive the light reflected from the reflective cover 90 and visually feel that the storage compartment 21 appears wider.

In an embodiment, the upper duct 60 may include a front body 67 forming the upper outlet 62 together with the module coupling portion 65. The front body 67 may be disposed on a front side of the upper outlet 62 to guide the cold air flowing through the upper outlet 62 downwardly towards the storage compartment 21.

In an embodiment, the refrigerator 1 may further include a lower cover 80 provided to cover a lower side of the module coupling portion 65. The lower cover 80 may include a guide wall 81, a partition wall 82, and a receiving groove 82*a*. The guide wall 81 may form the upper outlet 62 together with the discharge wall 65*a*. The guide wall 81 may be arranged so as to guide the cold air discharged from the upper outlet 62 towards the storage compartment 21.

In an embodiment, the lower cover 80 may include the partition wall 82 spaced apart from the guide wall 81 to form the receiving groove 82*a*. The partition wall 82 may be provided to protrude upwardly and may include an insertion groove 82*b* directed in the lateral direction (X direction).

In an embodiment, the LED module 100 may be obliquely inserted into the receiving groove 82*a*. In particular, a lower end 102*b* of the base of the LED module 100 may be obliquely inserted into the receiving groove 82*a*. The receiving groove 82*a* may be formed on a front side of the recess 65*b*. The lower end 102*b* of the base is positioned forward of the upper end 102*a* of the base, and thus the base 102 may be installed in an upwardly direction at an angle to the upper duct 60 and downwardly at an angle to the lower cover 80. Accordingly, this structure may allow the light from the plurality of LEDs 101 to be emitted toward the storage compartment 21. In addition, the arrangement of the partition wall 82 may reflect light that may leak into the front side of the storage compartment 21, thereby preventing light from being emitted toward the front side of the storage compartment 21. In other words, by preventing light leakage, light may be efficiently delivered to the storage compartment 21 using a smaller number of LEDs, resulting in a brighter storage compartment 21.

In an embodiment, the lower cover 80 may include a front cover 86. The front cover 86 may form the upper outlet 62 together with the guide wall 81. The front cover 86 may be disposed on the front side of the upper outlet 62 to guide the cold air flowing through the upper outlet 62 downward toward the storage compartment 21.

In an embodiment, the front body 67 and the front cover 86 may be arranged in an upward and downward fashion, respectively, to form the upper outlet 62 on the rear side to guide the cold air toward the storage compartment 21. A front surface of the front cover 86 may be engraved with a design phrase or the like.

In an embodiment, the plurality of LEDs 101 may be disposed on a rear side of the inclined base 102 to emit light toward the reflective cover 90 disposed on the rear side of the storage compartment 21. Each of the plurality of LEDs 101 may emit light at an irradiation angle of 120 degrees. The light from each of the plurality of LEDs 101 may be directed to the inclined surface 65*c* and/or a light guide panel 95.

In an embodiment, the inclined surface 65*c* may be inclined downward and backward from the recess 65*b* and may reflect light from the plurality of LEDs 101 to the light guide panel 95. In other words, the inclined surface 65*c* may include a reflective surface for reflecting light. The reflective surface 65*c* may be formed to reflect light from the plurality of LEDs 101 toward the storage compartment 21.

In an embodiment, the refrigerator 1 may include the lower cover 80 coupled to a lower side of the upper duct 60 to allow the LED module 100 to be disposed between the lower cover 80 and the upper duct 60. The refrigerator 1 may include the light guide panel 95 coupled to the lower cover 80 to diffuse light coming from the plurality of LEDs 101 and the inclined surface 65*c*. The light guide panel 95 may uniformly diffuse the light emitted from the plurality of LEDs 101 and/or the light reflected from the inclined surface 65*c* toward the storage compartment 21. Such a structure may allow light to be uniformly emitted into the storage compartment 21 with an arrangement of a relatively small number of LEDs.

In an embodiment, the lower cover 80 may include a seating surface 83 disposed on a rear side and a plurality of coupling protrusions 84 protruding upwardly from the seating surface 83. The plurality of coupling protrusions 84 may be spaced apart from each other and arranged in the lateral direction (X direction). An insertion space (not shown) may be formed between each of the plurality of coupling protrusions 84.

In an embodiment, the light guiding panel 95 may include a light guiding body 95*a*, an insertion protrusion 95*b*, and a receiving space (not shown). The insertion protrusion 95*b* and the receiving space may be disposed on a rear side of the light guiding body 95*a*. The light guide panel 95 may include a plurality of insertion protrusions 95*b*. The plurality of insertion protrusions 95*b* may be arranged to be spaced apart from each other along the lateral direction (X direction). The receiving space may be formed between each of the plurality of insertion protrusions 95*b*.

In an embodiment, the insertion protrusion 95*b* may be seated on the seating surface 83 and may be inserted rearwardly in response to the insertion space (not shown). The coupling protrusion 84 may be received in response to the receiving space (not shown). As the insertion protrusion 95*b* is inserted into the insertion space, the coupling protrusion 84 may be accommodated in the receiving space, and thus the light guide panel 95 may be coupled to the lower cover 80.

In addition, corresponding to this structure, in an embodiment, the light guide panel 95 and the lower cover 80 may also be coupled together on a front side. Accordingly, this structure may allow the light guide panel 95 to be stably coupled to the lower cover 80.

In an embodiment, the light guide panel 95 may be disposed to be inclined upwardly toward the rear. The inclined arrangement of the light guide panel may allow light coming from the plurality of LEDs 101 or the inclined surface 65*c* to be further diffused toward the reflective cover 90. By this structure, more light may be directed to the reflective cover 90 and the light reflected by the reflective cover 90 illuminates the storage compartment 21, thereby making the storage compartment 21 to appear wider and deeper to the user.

In an embodiment, the module coupling portion 65 may include a module support portion 66. A plurality of module supports 66 may be provided and may be spaced apart from each other along the lateral direction (X direction).

In an embodiment, the module support portion 66 may be formed to protrude downwardly from the upper cover 63 (see FIG. 4). The module support portion 66 may be configured to support the LED module 100. The module support portion 66 may include a plurality of ribs extending from the upper cover 63.

In an embodiment, the module support portion 66 may include a support body 66*a*, a support protrusion 66*b*, and a support face 66*c*. The support body 66*a* may be formed to protrude downwardly from a portion of a rear wall forming the recess 65*b*. The support body 66*a* may be arranged in the insertion groove 82*b* of the partition wall 82 of the lower cover 80. The support protrusion 66*b* may be formed on a rear side of the support body 66*a*. The support face 66*c* may protrude forwardly from the support body 66*a* to support the LED module 100. More specifically, the support face 66*c* may support the lower end 102*b* of the base. The configuration of the module support portion 66 may allow the LED module 100 to be stably coupled to the upper duct 60.

Figure 9:
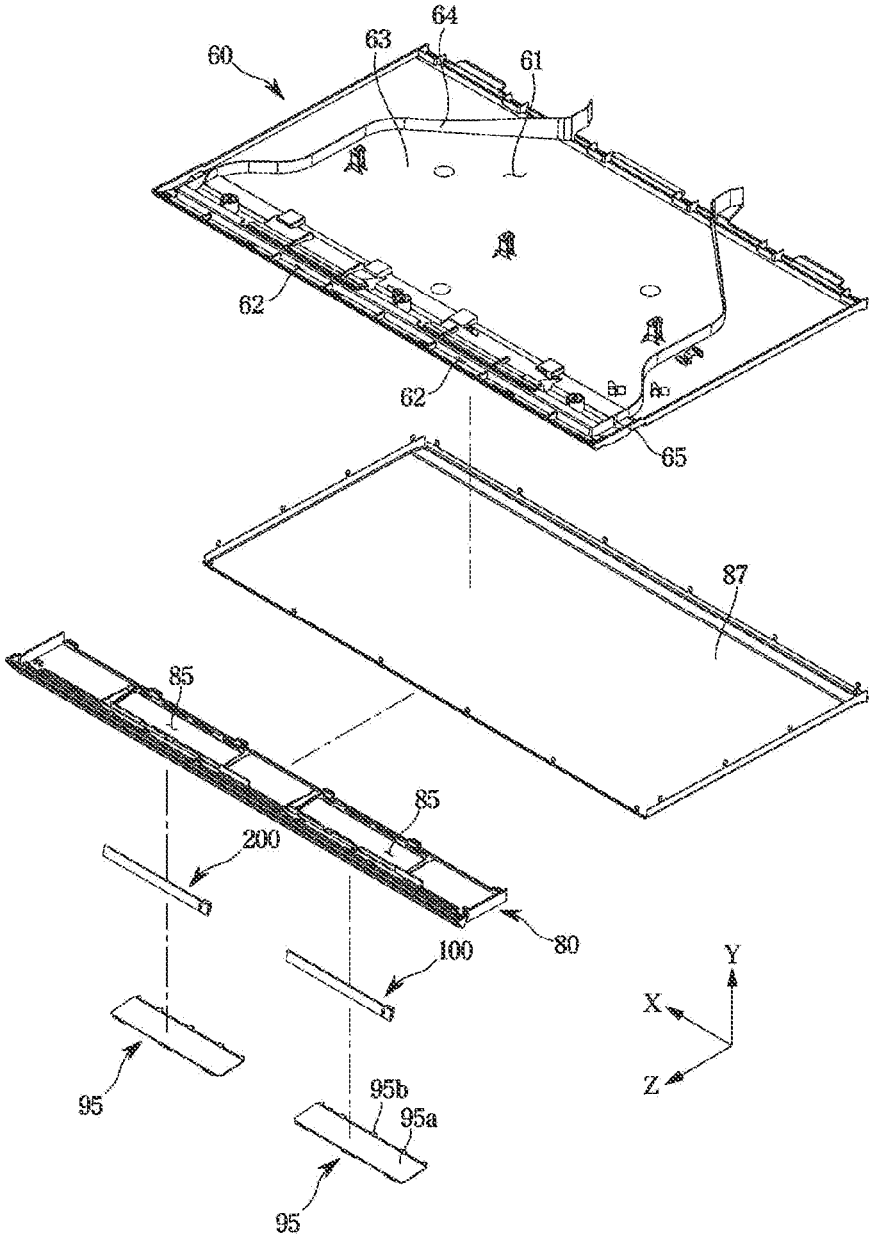
FIG. 9 is an exploded perspective view of the upper duct and the LED module of the refrigerator shown in FIG. 1, according to an embodiment.

In an embodiment and referring to FIG. 9, the lower cover 80 may be coupled to the lower side of the upper duct 60. A body cover 87 may be coupled to the lower side of the upper duct 60. The lower cover 80 may be placed on the front side of the storage compartment 21, and the body cover 87 may be placed on the rear side of the storage compartment 21. The lower cover 80 and the body cover 87 may be coupled together in a front-back direction (Z direction). In contrast to an embodiment, the lower cover 80 and the body cover 87 may be formed as one piece.

In an embodiment, the refrigerator 1 may include the first LED module 100 and a second LED module 200. The first LED module 100 and the second LED module 200 may be spaced apart in the lateral direction (X direction) and coupled to the upper duct 60. The second LED module 200, as in the first LED module 100, may include a plurality of LEDs arranged in the lateral direction (X direction). The installation structure of the second LED module 200 may correspond to that of the first LED module 100 shown in FIG. 6. In an embodiment, two LED modules are shown, but the invention is not limited thereto. Alternatively, the first LED module 100 and the second LED module 200 may be extended to form a single unit.

Figure 8:
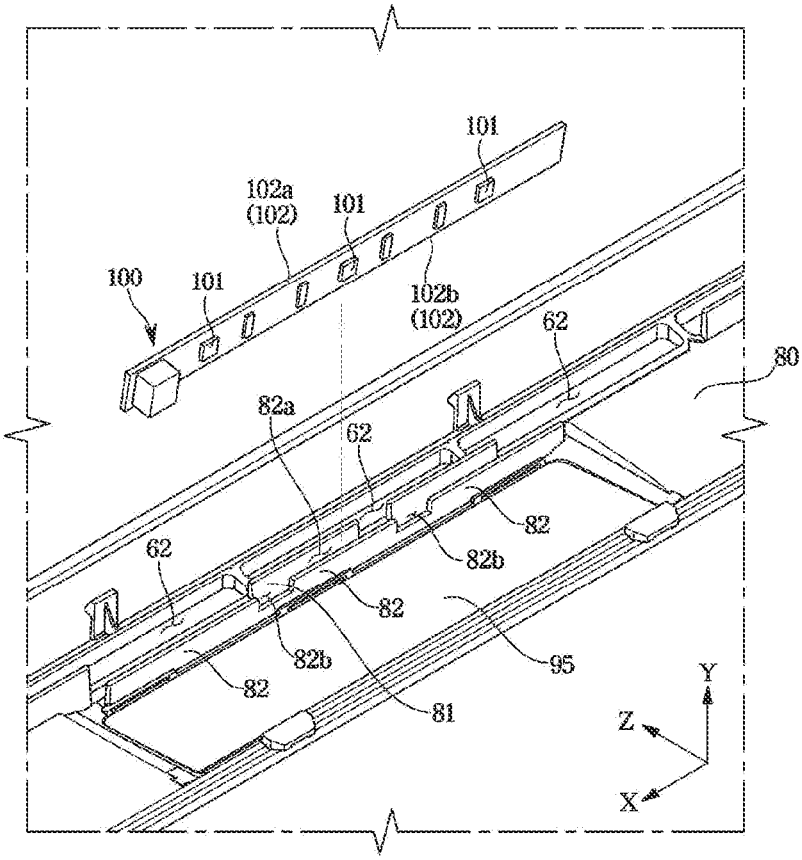
FIG. 8 is a perspective view illustrating a lower cover of the refrigerator shown in FIG. 1 and the LED module being coupled therewith, according to an embodiment.

In an embodiment, the lower cover 80 may include one or more the upper outlets 62 (see FIG. 8). The upper outlet 62 (see FIG. 8) of the lower cover 80 may be in communication with the upper outlet 62 of the upper duct 60. An opening 85 may be formed in the lower cover 80. The lower cover 80 and the light guide panel 95 may be coupled through the opening 85 of the lower cover 80.

Figure 10:
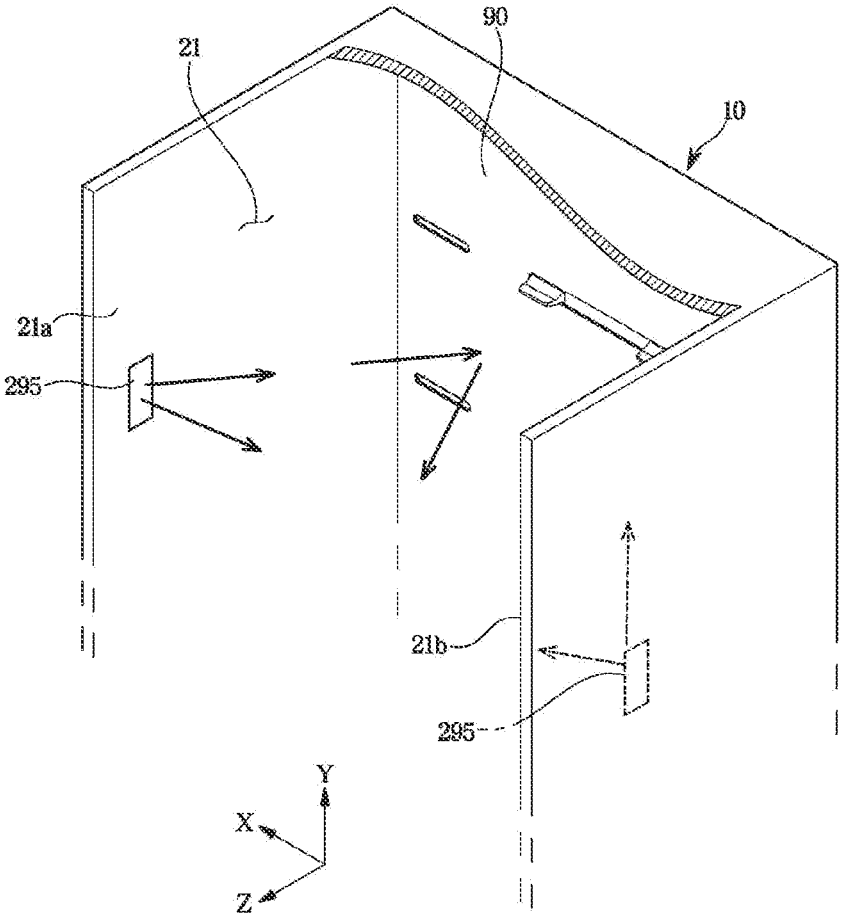
FIG. 10 is a cut-away perspective view illustrating a light guide panel of the refrigerator shown in FIG. 1, according to an embodiment.
Figure 11:
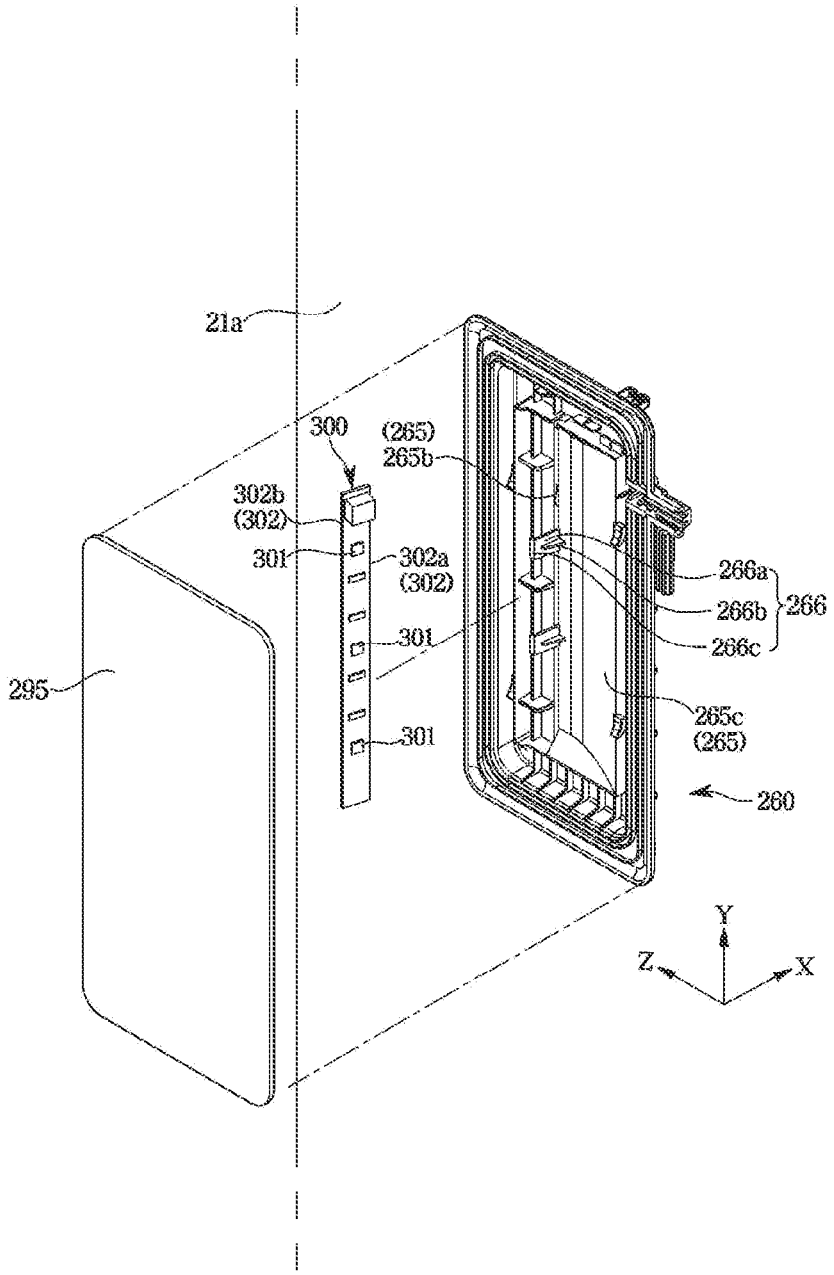
FIG. 11 is an exploded perspective view illustrating a third LED module and the light guide panel of the refrigerator of FIG. 1, according to an embodiment.

In an embodiment and referring to FIGS. 10 and 11, the refrigerator 1 may include a third LED module 300 provided on both sides of the storage compartment 21 to emit light toward the storage compartment 21. A plurality of third LED modules 300 may be provided. In an embodiment, the third LED module 300 may be provided as a pair on the left wall 21*a* and the right wall 21*b* of the storage compartment, but is not limited thereto.

In an embodiment, the third LED module 300 may include a plurality of LEDs 301 arranged in a vertical direction (Y direction). The third LED module 300 may include a base 302 extending in the vertical direction (Y direction) to allow the plurality of LEDs 301 to be arranged vertically. The base 302 may be installed at an angle on a module cover 260 which may be disposed on the left wall 21*a* of the storage compartment 21. In other words, the base 302 may be installed at an angle to a module coupling portion 265.

In an embodiment, the module coupling portion 265 may include a recess 265*b* which may be recessed in the lateral direction, an inclined surface 265*c* which may be inclined rearwardly and inwardly from the recess 265*b*, and a module support portion 266. The module support portion 266 may include a support body 266*a*, a support protrusion 266*b*, and a support face 266*c*, wherein the support face 266*c* may protrude in a direction that is forwardly from the support body 266*a* to support the base 302.

In an embodiment, a light guide panel 295 may be provided to cover the third LED module 300. The light guide panel 295 may be coupled to the module cover 260 to cover at least a portion of the module cover 260. The configuration of the light guide panel 295 may correspond to that of the light guide panel 95 shown in FIG. 6. As mentioned above, the configuration of the third LED module 300 may correspond to the first LED module 100. According to an embodiment, the plurality of LEDs 301 may be arranged, as corresponding to the first LED module 100, to emit light toward the reflective cover 90.

Figure 12:
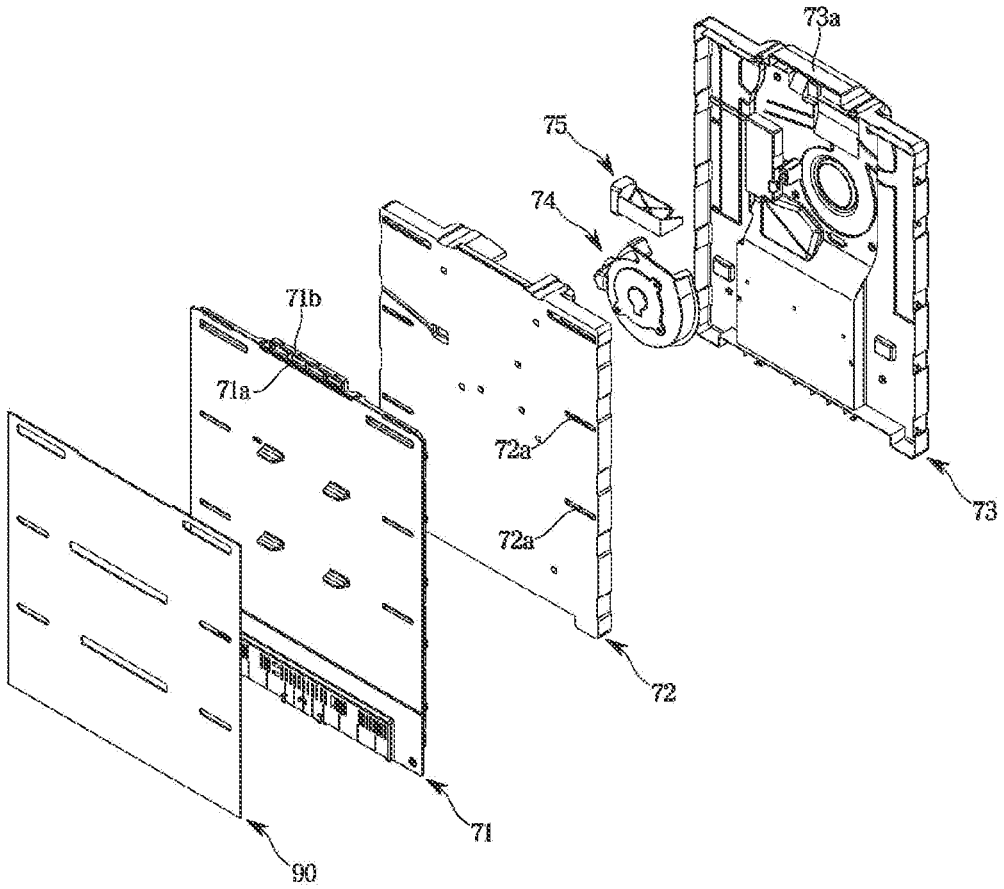
FIG. 12 is an exploded perspective view illustrating a rear duct and reflective cover of the refrigerator of FIG. 1, according to an embodiment.

In an embodiment and referring to FIGS. 2 and 12, the rear duct 70 may be disposed on the rear side of the storage compartment 21. The rear duct 70 may include a front cover 71, a middle cover 72, and a rear cover 73. The front cover 71 may be provided on a rear side of the reflective cover 90 and may include the cold air supply port 71*a* that supplies cold air to the upper duct 60.

In an embodiment, a plurality of cold air supply ports 71*a* may be provided and may be disposed on an upper side of the front cover 71. Each of the cold air supply ports 71*a* may be spaced apart from each other by the cold air supply frame 71*b*. The cold air supply port 71*a* may be in communication with the upper flow path 61.

In an embodiment, the middle cover 72 may be disposed on the rear side of the front cover 71 to guide the cold air to the upper duct 60 and the cold air supply port 71*a*. The middle cover 72 may include the rear outlet 72*a* that discharges the cold air introduced into the rear flow path 73*b* through the blower fan 74 to the storage compartment 21. The plurality of rear outlets 72*a* may be provided.

In an embodiment, the rear cover 73 may be disposed on a rear side of the middle cover 72 and may be coupled with the middle cover 72. The rear cover 73 may be coupled to the rear side of the middle cover 72 to form the rear flow path 73*b* that guides the cold air to the upper duct 60 and the cold air supply port 71*a*. The rear flow path 73*b* may be surrounded by the middle cover 72, a pair of guide walls (not shown), and the rear cover 73.

In an embodiment, the rear duct 70 may include the blower fan 74 disposed on the middle cover 72 to circulate the cold air generated from the evaporator 6 to the rear flow path 73*b*. The rear duct 70 may include a damper 75 for regulating a flow of cold air in the rear flow path 73*b*. The damper 75 may be disposed adjacent to the cold air supply port 71*a*.

Figure 13:
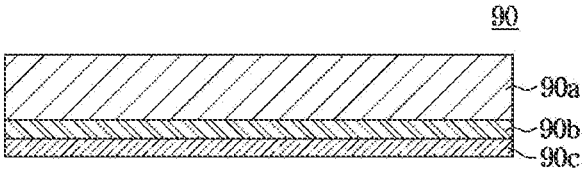
FIG. 13 is a schematic view illustrating the reflective cover of the refrigerator of FIG. 1, according to an embodiment.

In an embodiment, a configuration of the reflective cover 90 will be described with reference to FIG. 13. The reflective cover 90 may include a cover body 90*a*, a deposition surface 90*b*, and a printing surface 90*c*. The reflective cover 90 may include a glass material.

In an embodiment, the cover body 90*a* may support the deposition surface 90*b* and the printing surface 90*c*. The deposition surface 90*b* may have a light transmittance of about 74%. The printing surface 90*c* may be disposed on a rear side of the deposition surface 90*b* to reflect light passing through the deposition surface 90*b*. In an embodiment, according to this structure, more of the light emitted to the reflective cover 90 may be reflected toward the storage compartment 21. This may allow the user to perceive the storage compartment 21 as a wider storage space.

Figure 14:
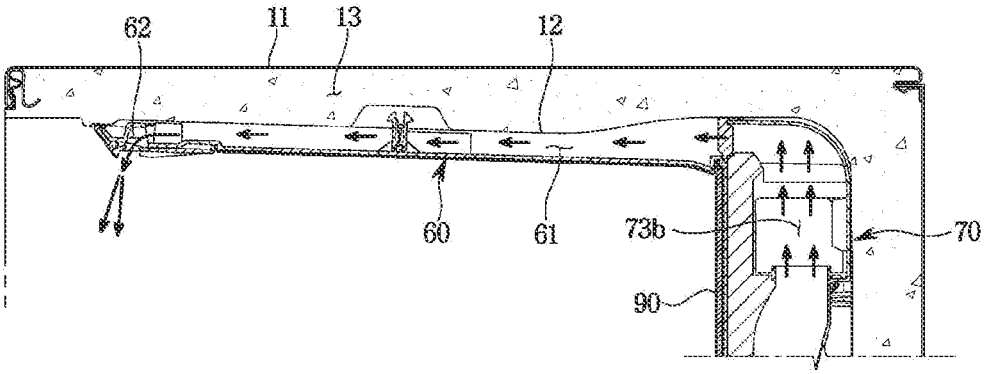
FIG. 14 is a view illustrating a flow of cold air when a door of the refrigerator of FIG. 1 is opened, according to an embodiment.

In an embodiment and referring to FIGS. 1, 2, and 14, the effect of preventing fogging on the reflective cover 90 when the door 30 is opened will be described in detail. The refrigerator 1 may include a controller (not shown) provided to detect whether the door 30 is opened or closed. When the door 30 is opened, the controller may detect the open state of the door and send a signal to cause the blower fan 74 to rotate faster. The faster rotating blower fan 74 may allow the cold air generated by the evaporator 6 to flow into the rear flow path 73*b* more quickly. As a result, more cold air may be discharged downwardly at the front side of the storage compartment 21 through the upper flow path 61 and the upper outlet 62.

According to an embodiment, although the door 30 is opened, high-temperature and high-humidity outside air may be prevented from flowing into the storage compartment 21 by the cold air discharged from the upper outlet 62. In other words, it is possible to prevent high-temperature and high-humidity outside air from reaching the reflective cover 90, thereby preventing fogging of the reflective cover 90. Accordingly, even when the door is open, the user may still perceive that the storage compartment 21 appears to be deeper and wider through the reflective cover 90, and may feel a high-end design and aesthetic satisfaction.

Although the embodiments of the invention have been described, it is understood that the invention should not be limited to these embodiments but various changes and modifications can be made by one of ordinary skilled in the art within the spirit and scope of the present invention as herein described. Therefore, the invention should not be limited to any single embodiment described herein, and the scope of the invention shall be determined according to the description and the attached claims. Moreover, the embodiments or parts of the embodiments may be combined in whole or in part without departing from the scope of the invention.

What is claimed is:

1. A refrigerator, comprising:

an outer case;

an inner case disposed inside the outer case to form a storage compartment;

an upper duct including an upper outlet disposed on an upper portion of the storage compartment to discharge cold air downward toward the storage compartment, and disposed in the inner case to form an upper flow path to supply the cold air to the upper outlet;

a rear duct including a rear flow path configured to guide the cold air to the upper flow path, and a rear outlet configured to discharge cold air from the rear flow path into the storage compartment to cool the storage compartment;

a light emitting diode (LED) module coupled to the upper duct to emit light toward the storage compartment and including a plurality of LEDs arranged in a lateral direction; and a reflective cover disposed on a rear side of the storage compartment so as to be coupled to the rear duct and configured to reflect light from the LED module toward the storage compartment, wherein light emitted from the LED module toward the reflective cover is reflected by the reflective cover toward the storage compartment.

2. The refrigerator of claim 1, wherein the LED module is installed in the upper duct at an angle to allow the plurality of LEDs to emit light in a downwardly inclined direction toward the reflective cover.

3. The refrigerator of claim 2, wherein the upper duct includes an inclined surface inclined in a downwardly direction toward a rear side to reflect light from the plurality of LEDs toward the storage compartment.

4. The refrigerator of claim 3, further comprising:

a lower cover coupled to a lower side of the upper duct such that the LED module is disposed between the upper duct and the lower cover, and a light guide panel coupled to the lower cover to diffuse light emitted from the plurality of LEDs and reflected from the inclined surface.

5. The refrigerator of claim 4, wherein the light guide panel is inclined upwardly toward a rear side thereof.

6. The refrigerator of claim 1, wherein the LED module includes a base extending in the lateral direction to allow the plurality of LEDs to be arranged in the lateral direction, and wherein the base is installed in the upper duct at an angle to allow the plurality of LEDs to emit light in a downwardly inclined direction toward the reflective cover.

7. The refrigerator of claim 6, wherein the upper duct includes a module coupling portion disposed on a rear side of the upper outlet, the module coupling portion including a recess that is recessed in an upwardly direction in the storage compartment, and wherein an upper end of the base is inserted into the recess.

8. The refrigerator of claim 7, wherein the module coupling portion further includes a module support portion located adjacent to the recess and extending downward, and wherein the module support portion supports a lower end of the base.

9. The refrigerator of claim 7, further comprising a lower cover configured to cover a lower side of the module coupling portion, wherein the lower cover includes a guide wall arranged to guide the cold air discharged from the upper outlet, and a partition wall spaced apart from the guide wall to form a receiving groove in which a lower end of the base is received.

10. The refrigerator of claim 1, wherein the LED module is a first LED module, and the refrigerator further includes a second LED module coupled to the upper duct to be spaced apart from the first LED module in the lateral direction, wherein the second LED module includes a plurality of LEDs arranged in the lateral direction.

11. The refrigerator of claim 1, wherein the reflective cover includes a glass material.

12. The refrigerator of claim 1, further comprising a plurality of third LED modules provided on both sides of the storage compartment to emit light toward the storage compartment and wherein the plurality of third LED modules include a plurality of LEDs arranged in a horizontal direction.

13. The refrigerator of claim 1, wherein the rear duct includes:

a front cover provided on a rear side of the reflective cover and including a cold air supply port configured to supply cold air to the upper duct;

a middle cover provided on a rear side of the front cover and configured to guide cold air to the upper duct and the cold air supply port;

a rear cover coupled to a rear side of the middle cover to form the rear flow path, wherein the rear flow path is configured to guide cold air to the upper duct and the cold air supply port; and a blower fan disposed on the middle cover and configured to blow cold air into the rear flow path.

14. A refrigerator, comprising:

a main body;

a storage compartment formed in the main body and having a front opening;

a door configured to open and close the front opening;

an evaporator configured to generate cold air;

a rear duct including a rear flow path configured to guide cold air generated by the evaporator, and a rear outlet configured to discharge the cold air from the rear flow path into the storage compartment to cool the storage compartment;

an upper duct provided in the storage compartment, and including an upper flow path connected to the rear flow path and an upper outlet configured to discharge the cold air from the rear flow path in a direction downward toward the storage compartment;

a first light emitting diode (LED) module coupled to the upper duct to emit light in a direction toward the storage compartment and including a plurality of first LEDs arranged in a lateral direction;

a second LED module coupled to the upper duct to be spaced apart from the first LED module in the lateral direction and including a plurality of second LEDs arranged in the lateral direction;

a plurality of third LED modules arranged on both sides of the storage compartment and including a plurality of third LEDs arranged in a horizontal direction to emit light in a direction toward the storage compartment; and a reflective cover disposed on a rear side of the storage compartment, wherein the reflective cover is coupled to the rear duct and configured to reflect light from the first LED module, the second LED module, and the plurality of third LED modules toward the storage compartment, wherein light emitted from the first LED module, the second LED module and the plurality of third LED modules toward the reflective cover is reflected by the reflective cover toward the storage compartment.

15. The refrigerator of claim 14, wherein the first LED module and the second LED module are installed in the upper duct at an angle to allow the plurality of first LEDs and the plurality of second LEDs to emit light in a downwardly inclined direction toward the reflective cover.

16. The refrigerator of claim 14, wherein the first LED module includes a base extending in the lateral direction to allow the plurality of first LEDs to be arranged in the lateral direction, and wherein the base is installed in the upper duct at an angle to allow the plurality of first LEDs to emit light in a downwardly inclined direction toward the reflective cover.

17. The refrigerator of claim 15, wherein the upper duct includes an inclined surface that is inclined in a downwardly direction toward a rear side to reflect light from the plurality of first LEDs, the plurality of second LEDs and the plurality of third LEDs toward the storage compartment.

18. The refrigerator of claim 16, wherein the upper duct includes a module coupling portion disposed on a rear side of the upper outlet, the module coupling portion including a recess that is recessed in an upwardly direction in the storage compartment, and wherein an upper end of the base is inserted into the recess.

19. The refrigerator of claim 18, wherein the module coupling portion further includes a module support portion located adjacent to the recess and extending downward, and wherein the module support portion supports a lower end of the base.

20. The refrigerator of claim 18, further comprising a lower cover configured to cover a lower side of the module coupling portion, wherein the lower cover includes, a guide wall arranged to guide cold air discharged from the upper outlet, and a partition wall spaced apart from the guide wall to form a receiving groove in which a lower end of the base is received.

* * * * *